United States Patent [19]

Olson et al.

[11] Patent Number: 4,533,897

[45] Date of Patent: Aug. 6, 1985

[54] MINIATURE THERMAL SWITCH AND METHOD OF MAKING THE SAME

[75] Inventors: Harry W. Olson, Woodridge; Phillip A. Olson, Hoffman Estates, both of Ill., legal representative of said Harry W. Olson, deceased

[73] Assignee: Littelfuse, Inc., Des Plaines, Ill.

[21] Appl. No.: 489,342

[22] Filed: Apr. 28, 1983

[51] Int. Cl.[3] ..... H01H 37/76

[52] U.S. Cl. ..... 337/408; 29/623; 337/407

[58] Field of Search ..... 337/407, 408; 29/623

[56] References Cited

U.S. PATENT DOCUMENTS 4,255,736 3/1981 Kelley ..... 337/407

*Primary Examiner*—Harold Broome

*Attorney, Agent, or Firm*—Russell E. Hattis; Stephen R. Arnold

[57] ABSTRACT

A miniature thermal switch features simplified single-spring construction requiring only four components within an enclosure housing. None of the components requires subassembly, and all are designed for completely automated assembly of the finished switch. A fabrication method features self-alignment of the elements by means of closely confining barrier walls. A wiping action of the contacts during melting of a contact-restraining meltable pellet serves to insure an abrupt circuit interruption at the threshold temperature.

17 Claims, 18 Drawing Figures

FIG. 8A
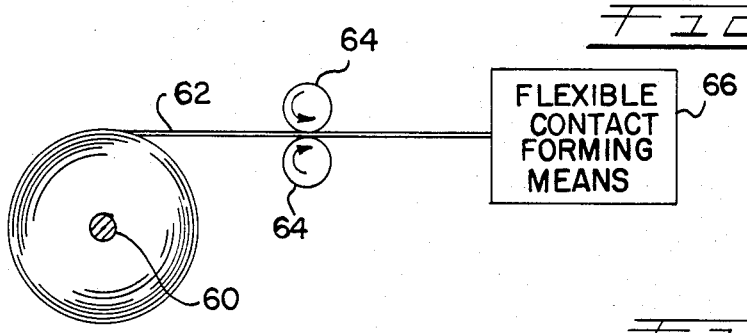
FIG. 8B
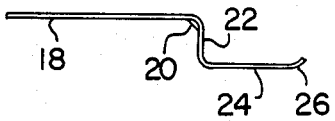
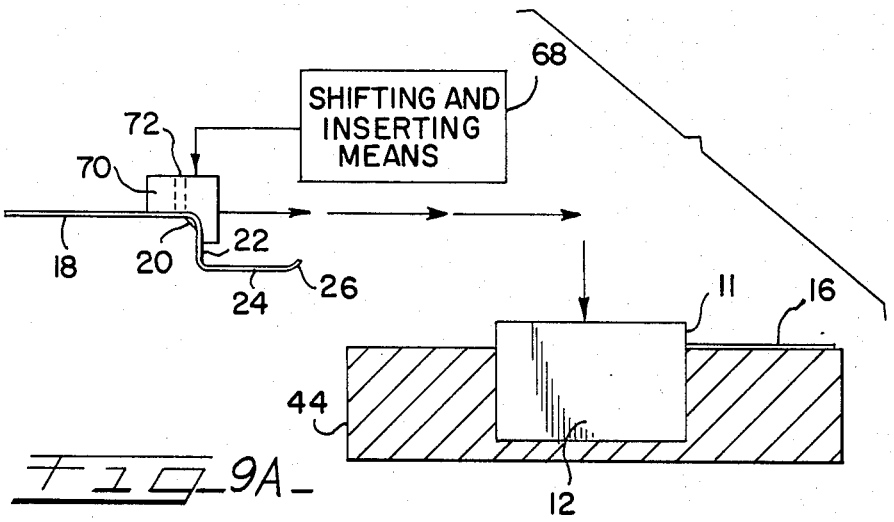
FIG. 9A
FIG. 9B
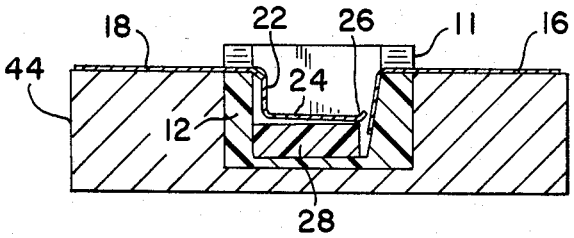

MINIATURE THERMAL SWITCH AND METHOD OF MAKING THE SAME

TECHNICAL FIELD OF THE INVENTION

The technical field of the invention is the electrical circuit breaker art, in particular to miniature thermally actuated switches useful, for example, to open the electric circuit thereto when devices proximate to the switch become overheated.

BACKGROUND OF THE INVENTION

Conventional miniature threshold temperature electrical switches employing a meltable element which melts when the ambient temperature of the circuit breaker reaches a chosen value, to allow actuation of a spring means to break an interior electrical contact suffer from several disadvantages. One typical circuit breaker comprises two opposing springs, one stronger than the other, the stronger spring holding two electrical contacting members together. The stronger spring is typically supported on a meltable pellet having a melting point at the chosen temperature. An opposing and weaker spring attempts to force the contacts apart. At a given temperature, the pellet melts, thereby removing the strong spring's arresting force, whereupon the weaker spring forces the contacts apart.

Such opposing spring systems tend to be inherently vibration sensitive, since the switch elements of the breaker are held in contact by a balance of opposing springs with a substantial mass therebetween, typically in the form of a pressure plate. Under impact or acceleration conditions, the mass of the pressure plate can overcome the force of its associated spring to allow the contacts the momentarily disengage, thereby giving rise to unreliability to the fuse under sufficiently high vibration conditions. Thus, a useful contribution to the fuse art would be represented by a thermal fuse element which has substantially improved vibration resistance.

Another disadvantage of these prior circuit breakers is that because of the construction and arrangements of their parts, they do not lend themselves readily to completely automated mass manufacturing techniques. Also, it would reduce the cost and simplify their assembly if one rather than two springs were utilized.

Additionally, a breaker shoulder ideally be manufactured completely from components which can be readily made by elementary techniques, e.g. die forming, injection molding, wire forming, etc., in such configuration that no subassembly is necessary, and wherein the fuse can be assembled by a series of elementary inexpensive manufacturing operations. A fuse overcoming any and preferably all of the above shortcomings would constitute a novel and useful contribution to the art. The thermal fuse of the present invention is such a fuse.

SUMMARY OF THE INVENTION

According to one feature of the invention, an improved thermal switch is configured without an apposing spring as described, and preferably without a pressure plate, so that in its most advantageous form the thermal switch includes in addition to the housing a pair of contact members of preferably an elongated ribbon-like configuration, a spring member, preferably a C-shaped spring member, and a meltable pellet. In the preferred form of the invention, the housing comprises a main housing body which in its position of assembly of the thermal switch presents an interior compartment opening to the top of the housing, to permit the different parts described to be sequentially positioned therein by dropping the same into the open top thereof to form a sandwich of elements. For this purpose the compartment preferably forms a guide channel for these parts, which have widths slightly less than the width of the guide channel-forming compartment. The parts of the thermal switch are then finally positioned by securing a cover over the housing which compacts the assembly of parts described by compressing the spring, which urges the contact-forming ends of the contact members together.

The contact members described preferably also form the terminal members of the thermal switch, and so have outer end portions which project outwardly from the housing, preferably in opposite directions and in the plane of the interface between the cover and the main body of the thermal switch housing. The thermal switch as described can be readily assembled by completely automated machinery, so that the cost of manufacture of the thermal switch is greatly reduced.

Whether or not the parts are configured and assembled in the manner above described, in accordance with the broadest aspect of the invention, the thermal switch includes a pair of elongated contact members having their outer ends emerging from the housing, the interior end of one of the contact members being deflected toward and against the interior end of the other contact member by a compressed spring disposed on one side of the inner ends of the contact members. A meltable pellet is positioned on the other side of the interior ends of the contact members and supports the contact members in a spring urged contact making position. When the threshold ambient temperature which is to cause the thermal switch to open is reached, the pellet melts and the spring expands to force the inner end portion of one of the contact members permanently away from the inner end portion of the other contact member.

In its most ideal form, assuming an orientation of the thermal switch housing its position of assembly, the contact member having the bottommost inner end portion preferably extends along and is backed by a vertically extending outwardly sloping shoulder at one end of the main housing body. The meltable pellet is preferably suppoted on the bottom of the housing slightly to one side of the bottom end of the contact member just described, so that the inner end of this contact member does not interfere with the dropping of the pellet into the bottom of the housing, if the contact member rather than the pellet is first inserted into the housing.

The other contact member preferably has a flexible, spring-forming end portion having a first downwardly extending intermediate section terminating in a generally horizontally extending section resting upon the top surface of the pellet. The end of this horizontal section turns upwardly to engage the rigid outer face of the first mentioned contact member. The spring member, which is preferably the C-shaped spring described, has a bottom horizontal leg bearing upon the upper surface of the horizontal section of the second mentioned contact member, and a horizontal upper leg which is pressed downwardly by the inner face of the cover when it is secured to the main body portion of the housing. The upturned end of the latter contact member is in wiping engagement with the former contact member, so that when the pellet melts, the bottom leg of the C-shaped spring member moves downwardly pushing the upturned end of the first contact member downwardly along and then away from the end of the former contact member to separate these contact members permanently.

In accordance with a method aspect of the invention, the thermal switch is fabricated in a manner previously described where the parts are readily deposited in sequence through an opening at the top of the main housing body, and is then finally completed by securing the cover in place to compact the spring as described. To facilitate the assembly of the spring, the main housing body, as previously described, comprises closely spaced main vertical walls forming a narrow guide channel for the various parts of the fuse sequentially dropped into places. The cover is also preferably positioned between the upper margins of these vertical main housing body walls.

Other advantages, and features of the invention will become apparent upon making reference to the description to follow, the drawings, and the claims.

DESCRIPTION OF DRAWINGS

FIGS. 8A and 8B show steps of forming a flexible contact member of the switch of FIGS. 1-4;

FIGS. 9A and 9B show the step of inserting the flexible contact member into the switch housing;

DETAILED DESCRIPTION OF PREFERRED FORM OF THE INVENTION

The subject matter of the preferred form of the invention is an improved miniature thermal switch having a circuit breaking capability at a specified temperature, the switch design being substantially simplified over the prior art and configured for mass production fabrication without requiring subassembly of parts.

Figure 1:
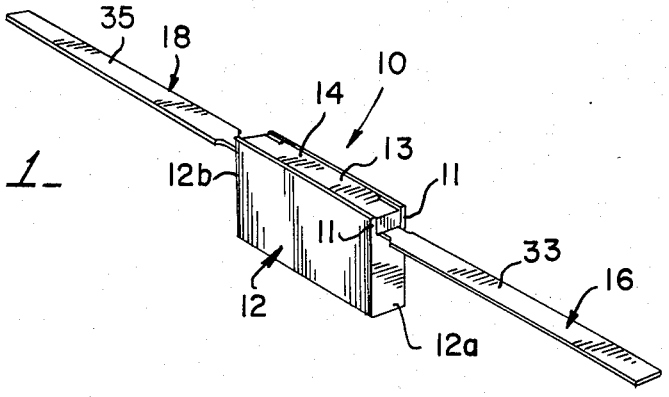
FIG. 1 is a perspective view of a thermal switch incorporating the preferred features of the present invention.

FIG. 1 is a perspective view of a thermal switch 10 incorporating all of the preferred features of the invention. As shown, the switch includes a narrow, horizontally elongated, rectangular, open-top main housing body 12 made of insulating material, a cover 14 made of insulating material, and two collinearly disposed metal terminal elements or contact members 16 and 18 having lead attachment outer end portions 33 and 35 extending horizontally outwardly through slots in the tops of vertical housing end walls **12*a*-12*b*. A pair of closely spaced vertical side walls 11 of the main housing body 12 define a narrow compartment and parts guide channel 13 opening onto the top thereof and containing the contact-forming inner end portions of the terminal elements 16 and 18, which are preferably ribbon like in shape. The cover 14 fits into the top of the compartment and parts guide channel 13 and bears on the tops of the head attachment portions 33 and 35** of the terminal elements and other switch parts to be described. The overall shape of the housing shown is such that its horizontal length and height are much greater than the width or thickness thereof.

Figure 2:
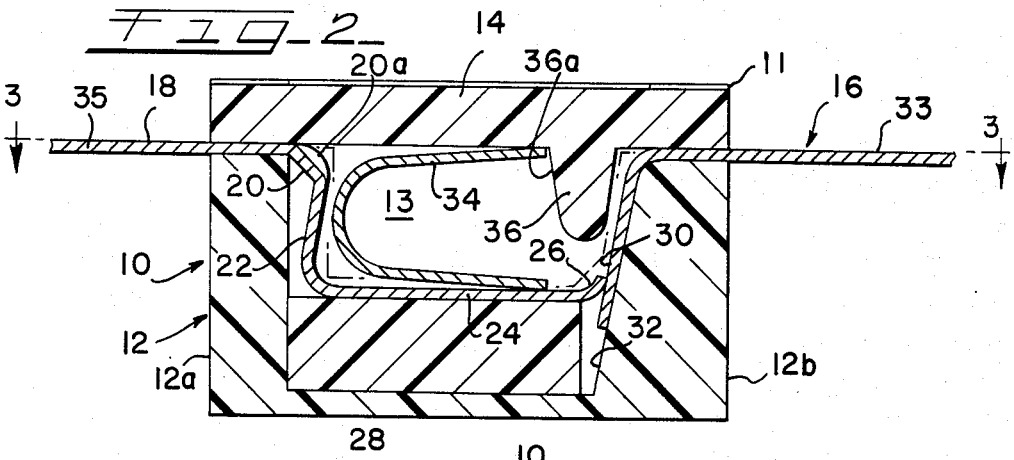
FIG. 2 is a vertical cross sectional view of the thermal switch of FIG. 1.

FIG. 2 shows the interior details of the switch 10. It will be seen that the housing body compartment 13 has a generally upwardly and outwardly sloping shoulder-forming interior wall surface 32 disposed on the right hand end of the main housing body as shown. At the bottom of the compartment 13 is placed a rigid meltable arresting pellet 28 made of an insulating material, and which fills almost the entire width and length of the bottom portion of the compartment 13 except that it is spaced to one side of the sloping wall surface 32. The pellet has the property that it is solid below a chosen threshold temperature. Various materials which are well known in the art may be used for such a pellet. These materials are commonly insulating organic materials having sharply defined melting temperatures. The contact-forming inner end portion 30 of terminal element 16 is a straight, downwardly and inwardly extending inclining portion following and pressed against the contour of the sloping shoulder-forming wall surface 32 of the housing body 12. The inner end portion of terminal element 18 is configured for flexure within the compartment 13, for which purpose it has a relatively stiff protrusion or dimple 20 at the inner end of the horizontal lead attachment end portion 35 thereof, just inside the top of the housing end wall **12*a*. The protrusion or dimple 20 extends inwardly from the general plane of a downwardly curving knee portion 20*a* of the terminal element 18. The curved knee portion 20*a* joins a downwardly and outwardly inclining portion 22 terminating in a generally horizontally disposed pellet engaging portion 24, having an upturned contact-forming end 26. A C-shaped leaf spring 34 is held captive by the cover 14 at a positioning shoulder 36*a*, formed by a side of a downwardly projecting portion 36 of the cover 14. The spring 34 is compressively urged by the cover 14 to bear against the upper surface of the pellet engaging portion 24 of terminal element 18 to press it arrestingly against the upper surface of the pellet 28. The cover 14 may be anchored in place by ultrasonically welding it to the housing side walls 11**.

Thus, because of the end configuration 26 of terminal element 18, the urging action of the compressed spring 34, and the arresting action of the meltable pellet 28, the contact-forming end 26 of terminal element 18 is pressingly urged into electrically contacting wiping engagement with the contact forming end portion 30 of terminal element 16. In the preferred embodiment of the invention, both terminal elements 16 and 18 are fashioned from silver plated copper in generally ribbon or strap-like configuration, and, as will be subsequently discussed in connection with a method disclosure describing the preferred method for manufacture of the switch, a work hardening process during the formation of the elements 16 and 18 from round wire stock imparts a measure of resiliency to both of them. Also, the widths of the parts or elements 16, 18, 34 and 28 are only slightly less than the corresponding width of the guide channel formed by the vertical side walls 11 of the housing body 12 so that they are guided into place thereby when dropped ino the open top of the housing compartment 13.

Figure 3:
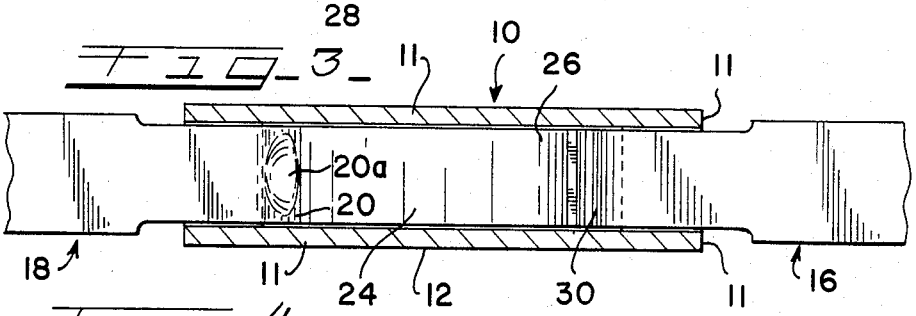
FIG. 3 is a plan view of the thermal switch of FIG. 1 with the cap portion removed.
Figure 4:
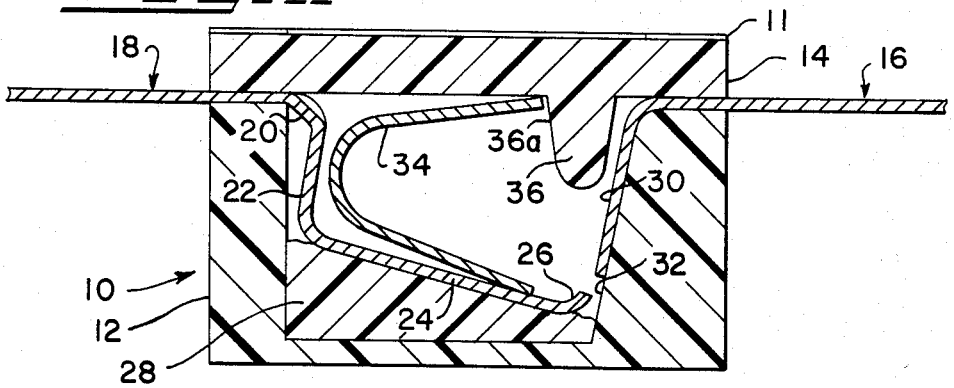
FIG. 4 is a vertical cross sectional view of the thermal switch after melting of an arresting pellet there causing actuation of the switch to an open circuit condition.

As the ambient temperature around the fuse 10 of FIG. 2 rises, communicating a rise in temperature through the walls of the housing body 12 to the pellet 28, ultimately the pellet melts and flows, thereby removing the arresting force holding the pellet engaging portion 24 of contacting element 18 in position as shown in FIG. 2, with the result that the compressed spring 34 urges the pellet engaging portion 24 of contacting element 18 downwardly to a withdrawn disengaging contact breaking condition as shown in FIG. 3. The purpose of the stiffener bend 20 shown in FIGS. 2 and 3 is to stiffen the lead element 18 in the vicinity in the wall, thereby preventing flexing of this element close to the housing wall, and thus providing a measure of side clearance between the adjacent housing wall and the vertical element 20, thereby allowing maximum disengaging travel of the contact wiping end 26 when the pellet melts.

It will be noted that, since any such thermal pellet 28 will always soften and yield somewhat befor melting as the temperature rises, contact is maintained during such yielding by downward wiping action of the contact-forming end 26 of terminal element 18 against the stationary contact-forming end 30 of terminal element 16. Complete melting of the pellet 28 then results in a clean snap-away release of the terminal element 18 from terminal element 16.

Prior art structures typically employ a pair of opposing springs, with a meltable pellet serving as the base for one spring, this spring forcing against and overpowering a second opposing spring to force a conducting contacting plate into contact with two conducting members connected to the fuse leads. Melting of the pellet allows the first spring to expand, whereupon the second weaker opposing spring forces the contact plate away from the members, thus breaking the circuit. The fuse of the present invention is much simpler, and enjoys a basic advantage over such two-spring systems, in that an improved measure of improved vibrational immunity is achieved by removing the second spring of conventinal structures. In the present design, spring 34 may be made arbitrarily stiff, consistent with the strength of the cover 14 and the crush resistance of the meltable pellet 28. Moreover, by using a C-shaped spring a maximum of spring travel for a given applied force is achieved, as contrasted with conventional coil springs, resulting in a more compact structure having a substantial spring travel available to maximize element travel when the pellet melts, thereby maximizing contact separation in the open-circuit condition.

Thus, the flexible terminal element 18 is arrestingly secured in position in a contacting configuration, whereas the opposing spring systems always act upon a force balance principle, wherein one spring overpowers the other to hold two contacts together. The susceptibility of such two-spring systems to intermittent contact interuption under impact or high vibration conditions is selfevident.

It will further be noted that all elements of the structure may be fabricated by conventional techniques, e.g. wire forming and injection molding. As a result, and in view of the topology of the system elements, it is clear that the structure lends itself to completely automatic fabrication, and in particular requires no special subassemblies to be separately assembled, as is routinely the case in the prior art.

FIGS. 5–12 show details of a manufacturing process using the advantages of the design of the previously mentioned fuse as adapted to automated mass production fabrication.

Figure 5A:
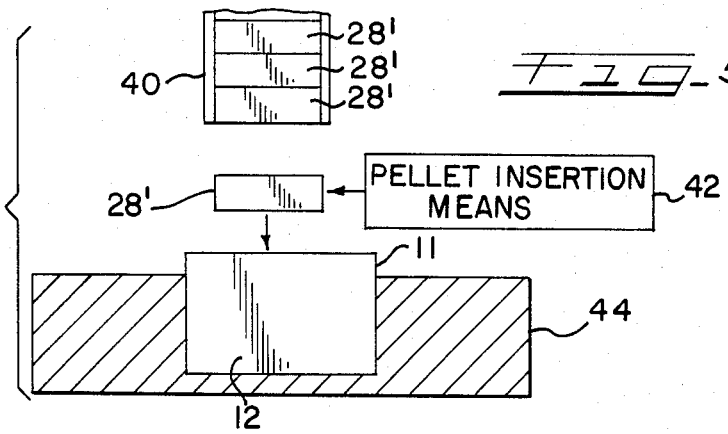
FIGS. 5A and 5B show the first stage of a manufacturing operation wherein a meltable pellet is disposed within the switch housing.
Figure 5B:
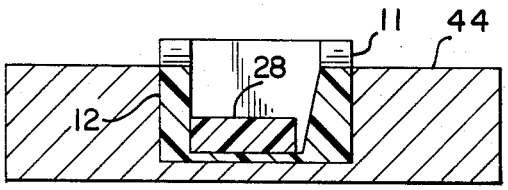

FIG. 5A shows a single housing body 12 carried by a housing carrier 44, movable to position the housing under a stack hopper 40 containing a supply of pellets 28'. A pellet insertion means 42, which may be any one of a variety of pick up and transfer methods well known in the art, transfers a pellet from the hopper 40 automatically to reside in the bottom portion of the housing body 12 as shown in FIG. 5B. Although a single housing body 12 is shown at this station, it will be understood that housing bodies may be carried in groups on a common housing carrier 44. In FIG. 5A, and in all subsequent figures, the direction of travel of housings is perpendicular to the plane of the figure.

Figure 6B:
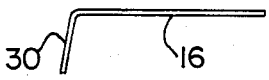
FIGS. 6A and 6B show a method for forming a rigid contact members of the switch of FIGS. 1-4.
Figure 6A:
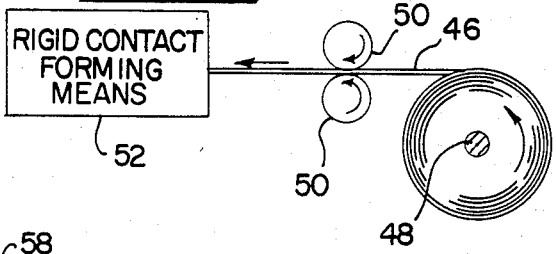

FIG. 6A shows one method of forming the rigid contacting element 16 from a supply of silver plated copper wire stock 46 dispensed from a dispensing roll 48 by means of propulsion rollers 50—50 to a contact forming means 52, here only functionally shown. Typically this operation would be carried out by means of a conventional wire-forming and shearing die. Such operation typically impart a measure of work-hardening and resiliency to the element 16.

FIG. 6B shows the contours of an individual terminal element 16 after being formed and sheared. The formed element 16 is removed from the forming means 52 by a shifting and inserting means 54, again of any conventional design, wherein a pickup element 56, here shown as a vacuum pickup provided with a vacuum hole 58 communicating with a vacuum system (not shown), whereby the contacting element 16 is helped and moved to the left over the housing 12 to be inserted therein in the disposition shown in FIG. 7B. The exterior end of element 16 is shown resting upon the top portion of the housing carrier 44 to hold it properly positioned for assembly. This element, as well as it counterpart element 18, may also be configured to be slightly overwidth with respect to the housing compartment 13 (See FIG. 3), so as to be held in position by friction after insertion to facilitate such assembly.

Next, referring to FIG. 8A, the terminal element 18 is formed from similar silver plated copper wire stock 62 dispensed from a dispensing spool 60 and moved into a contact forming means 66 by propulsion rollers 64, to be formed in a similar manner as was element 16 to take the form shown in FIG. 8B, with the stiffening protrusion 20 configured simultaneously. The stiffening protrusion 20 is most advantageously formed as a simple concave dimple as shown in FIG. 3.

The formed resilient element 18 is picked up by a second vacuum pickup 70 (FIG. 9A) having a vacuum attachment hole 72 and moved by conventional shifting and inserting means 68 to position the resilient element in the fuse housing 12 as shown in FIG. 9B.

Figure 7A:
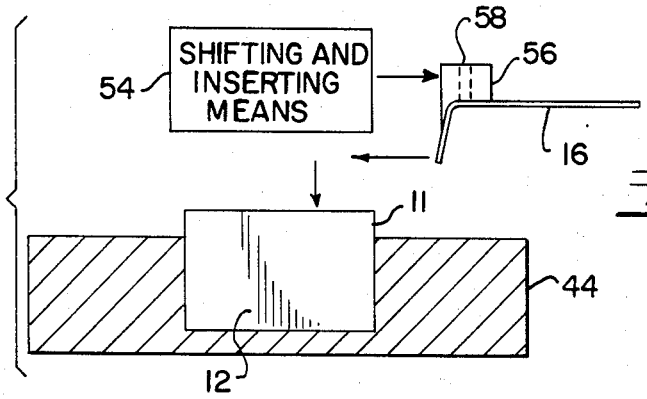
FIGS. 7A and 7B show the step of inserting the rigid contact member into the switch housing.
Figure 7B:
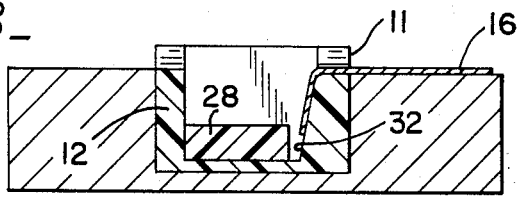

With respect to the insertion operation shown in FIGS. 9A, as well as that previously described with reference to FIG. 7A, by configuring the inwardly extending portions of elements 16 and 18 slightly smaller than the separation between the walls 11 (see FIG. 3) the walls provide a self-aligning feature to the inserted elements.

Figure 10A:
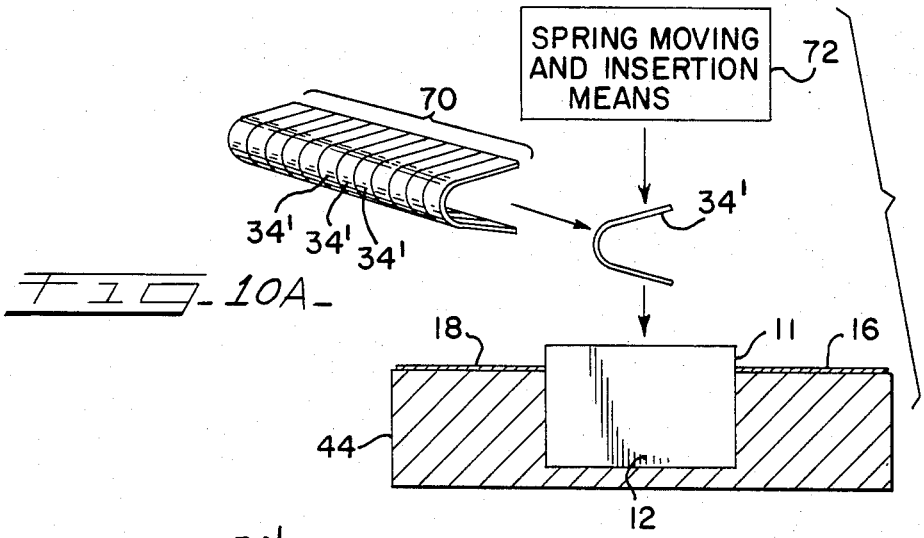
FIGS. 10 and 10B show the step of inserting a compression spring within the switch housing.
Figure 10B:
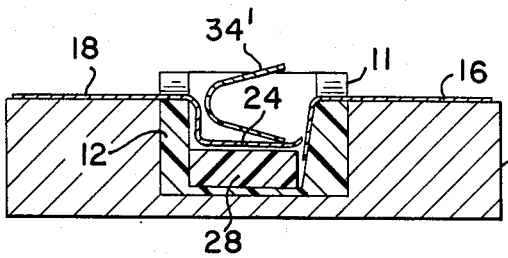
Figure 11:
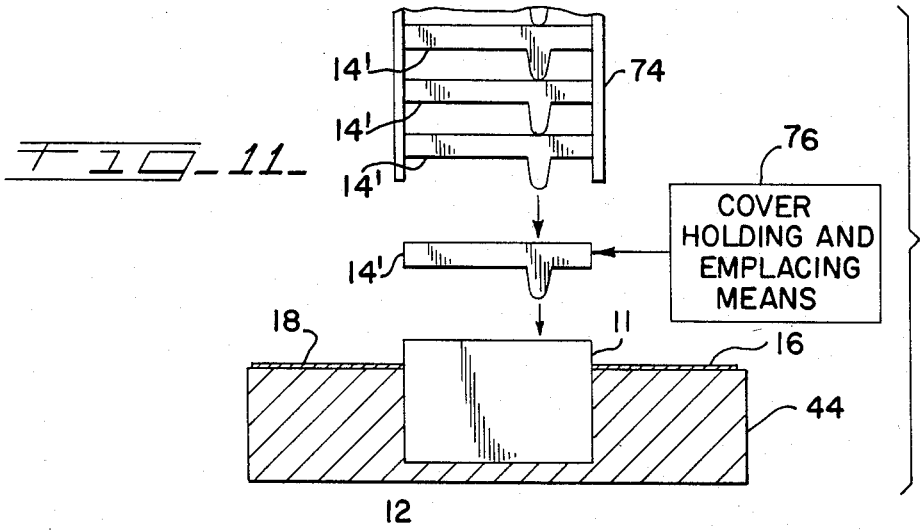
FIG. 11 shows the step of inserting a cap over the switch housing.
Figure 12:
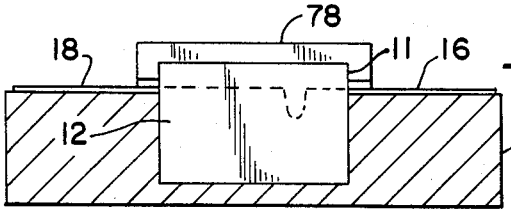
FIG. 12 shows the final step of sealing the cap to the housing, thereby completing the switch assembly.

A supply of C-shaped springs 34' (FIG. 10A), here shown disposed in an array 70 stored within a dispensing means (not shown), is provided to dispense one at a time by a spring moving insertion means 72, again of conventional design, which individually selects a spring 34' from the end of the array 70 to insert it into the housing 12 to rest loosely over the top of the pellet engaging portion 24 of terminal element 18 as shown in FIG. 10B.

A supply of housing covers 14' (FIG. 11) dispensed from a stack hopper 74 and moved by a cover moving and emplacing means 76 drops a cover into a seating engagement over the top of the housing body 12, where it is sealed, most preferably by an ultrasonic heat sealing element 78 (FIG. 12) to seal the entire structure together and compress spring 34 against the terminal element 18, to yield the structure shown in FIGS. 1 and 2. Alternatively themosetting adhesives may equally well be employed to seal the cover 14 into place.

It will be appreciated from the foregoing description that the fuse design of FIG. 1 is readily adapted to mass production manufacture. With respect to the individual steps shown in FIGS. 5–12, it is clear that each step may be performed at a separate station allowing a conveyer line carrying the housing bodies 12 as a group, and it is equally clear that many of the steps may be performed at a common station position. Thus, for example the lead forming operations of FIGS. 6A and 8A may be done at the same station, the lead elements being inserted immediately after formation.

Alternatively, the terminal elements 16 and 18 may be preformed as parallel fingers extending from ribbon stock dispensed by a dispenser, a large number of fingers being inserted into a large array of adjacent housing simultaneously. Under such fabrication conditions, provision must be made for subsequent shearing or breaking away of individual fingers from the carrier tape; however, such techniques are long known and well established in the art. With respect to the fuse design and fabrication method employed, it is clear that the manufacturing process requires no individual subassemblies of components, thereby resulting in a substantial economy and speed of manufacture.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to a particular embodiment disclosed as the best mode contemplated for carrying out the invention, but that the invention will include all embodiments falls within the scope of the appended claims.

For purposes of clarity in the claims, reference will be made to the "top" and "bottom" of the fuse with reference to the drawings as shown therein; however, it will be apparent to those knowledgeable in the art that other orientations are possible, and therefore no limitation on the scope of the appended claims is to be construed from the use of such terminology.

What is claimed is:

1. A thermally actuated electrical switch for permanently breaking an electrical connection responsively to a rise in the ambient temperature therearound above a given threshold temperature, said switch comprising:

an insulating housing having an interior compartment defined by the walls thereof:

first and second electrically conducting elongated contact members having outer ends thereof emerging from said housing, said conducting members having their interior ends disposed within the interior of said housing, the interior end of said first contact member being mechanically deflected towards and against the interior end of said second contact member to complete a circuit through said switch;

spring means disposed within said housing and on one side of the interior ends of said contact members and pressingly urging said first contact member against said second contact member in a given direction; and a solid meltable arresting member disposed within said housing on the other side of the interior ends of said contact members for arrestingly supporting one of said contact members against the force of said spring means acting in said given direction to maintain electrical contact between the contact members, said meltable arresting member having its melting point at said given threshold temperature, so that said arresting member melts at said threshold temperature to release said one of said contact members to separate from the other contact member under the force of said spring means in said given direction, and wherein said interior end of said second contact member is rigidly supported by and urged by said spring means against a sloping interior portion of said housing, so as to be pushed by said spring means along and beyond said first contact member when said arresting member melts.

2. The switch of claim 1 wherein the interior ends of said first and said second contact members are configured such that they separate by a wiping action movement of said first contact member against said second contact member.

3. The switch of claim 1 wherein said spring means moves said interior end of said first contact member by a wiping action along and beyond the interior end of said second contact member.

4. The switch of claim 1 wherein said housing includes a main open top housing into which said meltable arresting member, first and second contact members and spring means were sequentially inserted through said open top to form a sandwich of elements, and a sealing cover having an inner portion which presses against and holds said sandwich of elements together in the relationship described therein.

5. The switch of claim 4 wherein said meltable arresting member is disposed in the bottom of said compartment below said spring means and at least said first contact member.

6. The switch of claim 5 wherein said first and second contact members exit the upper portion of said housing in opposite directions over the tops of opposite end walls defining the ends of said compartment.

7. The switch of claim 6 wherein said contact members exit the housing at the interfaces between and opposite ends of said cover and housing body.

8. The switch of claim 4 wherein said main housing body has relatively closely spaced vertical side walls forming a guide channel therebetween for the passage of said sandwich of elements therein.

9. The switch of claim 7 wherein said spring means is immediately beneath said cover and is compressed thereby, the interior portion of said second contact member is supported against an upstanding interior wall surface at one end of said housing body and the interior portion of said first contact member is flexible and includes a flexible portion extending downwardly adjacent the other end of said housing and terminating in a horizontal portion extending to the interior portion of said second contact member where it makes contact therewith.

10. The switch of claim 9 wherein said upstanding wall surface slants downwardly and inwardly so that said interior end of said second contact member supported thereagainst also extends in the same direction, and the tip end of said horizontal portion of said interior portion of said first contact member is upturned to make a wiping resilient contact with said wall supported second contact member and leaves contact therewith when pushed by said spring means downwardly therebeyond when said meltable arresting member melts.

11. The switch of claim 1 wherein said spring means, meltable arresting member and first and second contact members are the only parts inside of said housing.

12. A thermally actuated electrical switch for permanently breaking an electrical connection responsively to a rise in the ambient temperature therearound above a given threshold temperature, said switch comprising:

an insulating housing having an interior compartment defined by the walls thereof;

first and second electrically conducting elongated contact members having outer ends thereof emerging from said housing, said conducting members having their interior ends disposed within the interior of said housing, the interior end of said first contact member being mechanically deflected towards and against the interior end of said second contact member to complete a circuit through said switch;

spring means disposed within said housing and on one side of the interior ends of said contact members and pressingly urging said first contact member against said second contact member in a given direction, said spring means being a C-shaped leaf spring; and a solid meltable arresting member disposed within said housing on the other side of the interior ends of said contact members for arrestingly supporting one of said contact members against the force of said spring means acting in said given direction to maintain electrical contact between the contact members, said meltable arresting member having its melting point at said given threshold temperature, so that said arresting member melts at said threshold temperature to release said one of said contact members to separate from the other contact member under the force of said spring means in said given direction, wherein said housing includes a main open top housing into which said meltable arresting member, first and second contact members and spring means were sequentially inserted through said open top to form a sandwich of elements, and a sealing cover having an inner portion which presses against and holds said sandwich of elements together in the relationship described therein.

13. A thermally actuated electrical switch for permanently breaking an electrical connection responsively to a rise in the ambient temperature therearound above a given threshold temperature, said switch comprising: an insulating housing having an interior compartment defined by the walls thereof; first and second electrically conducting elongated contact members having outer ends thereof emerging from said housing, said conducting members having their interior ends disposed within the interior of said housing, the interior end of said first contact member being mechanically deflected towards and against the interior end of said second contact member to complete a circuit through said switch; spring means disposed within said housing and on one side of the interior ends of said contact members and pressingly urging said first contact member against said second contact member in a given direction, said spring means being a compressed C-shaped leaf spring; a solid meltable pellet within said housing on the other side of the interior ends of said contact members for arrestingly supporting one of said contact members against the force of said spring means acting in said given direction to maintain electrical contact between the contact members, said meltable pellet having its melting point at said given threshold temperature, so that it melts at said threshold temperature to release said one of said contact members to separate from other contact member under the force of said spring means in said given direction, said housing including a main housing body having an opening at the top thereof and relatively closely spaced vertical side walls forming a guide channel therebetween leading to said opening, and into which channel said meltable pellet, first and second contact members and spring means are sequentially inserted through said open top to form a sandwich of elements, said contact members being of ribbon-like configuration, the width of said contact members, leaf spring and pellet being comparable to the width of said guide channel so that they are guided into place thereby, and a sealing cover having an inner portion which presses against and holds said sandwich of elements together in the relationship described therein.

14. The switch of claim 13 wherein said cover is also supported between said vertical side walls.

15. A thermally actuated electrical switch for permanently breaking an electrical connection responsively to a rise in the ambient temperature therearound above a given threshold temperature, said switch comprising: an insulating housing having an interior compartment defined by the wall thereof; first and second electrically conducting elongated contact members having outer ends thereof emerging from said housing, said conducting members having their interior ends disposed within the interior of said housing, the interior end of said first contact member being mechanically deflected towards and against the interior end of said second contact member to complete a circuit through said switch; spring means disposed within said housing and on one side of the interior ends of said contact members and pressingly urging said first contact member against said second contact member in a given direction; and a solid meltable arresting member disposed within said housing on the other side of the interior ends of said contact members for arrestingly supporting one of said contact members against the force of said spring means acting in said given direction to maintain electrical contact between the contact members, said meltable arresting member having its melting point at said given threshold temperature, so that said arresting member melts at said threshold temperature to release said one of said contact members to separate from the other contact member under the force of said spring means in said given direction, wherein said housing includes a main open top housing into which said meltable arresting member, first and second contact members and spring means were sequentially inserted through said open top to form a sandwich of elements, and a sealing cover having an inner portion which presses against and holds said sandwich of elements together in the relationship described therein, and wherein said meltable arresting member is disposed in the bottom of said compartment below said spring means and at least said first contact member, and said spring means being a leaf spring compressed by said cover downward to press said first contact member into contact with said second contact member.

16. A method for making a thermally actuated electrical switch, said method comprising the steps of: providing an insulating housing body having a guide channel-forming compartment therein opening onto the top of the housing so that the various parts of the switch can be sequentially dropped through the opening and guided into place within the housing body, an insulating cover, first and second contact members having lead attachment portions adapted to extend outside of said main housing body and having contact-forming inner portions adapted to be located inside the main housing body so as to be able to contact one another, spring means to be located inside of said housing body and compressed to force the ends of said contact-forming portions of said contact members into engagement with one another, said spring means being a C-shaped member having upper and lower horizontal legs to be compressed between one of said contact members and a stationary wall surface in said housing, and a rigid meltable pellet to be located on one side of the contacting portions of said contact member, said spring means to be located on the other side of said contacting portion, said meltable pellet, said first and second contact members and said spring means in an uncompressed state being sized to be guided into position within said guide channel-forming compartment of said main housing body when dropped into the opening in the top thereof and to form a vertical sandwich of elements to be urged together by the inner surface of said cover; sequentially dropping said meltable pellet, said first and second contact members, and said spring means member in proper order through the opening at the top of said housing; and securing said sealing cover over the open top of the housing so that said inner surface of said cover presses down on the sandwich of elements to compress said spring means and cause the contact members to be resiliently contactingly engaged and to separate when said pellet melts to permit said spring means to expand.

17. The method of claim 16 wherein said main housing body has a downwardly inwardly sloping shoulder at one end thereof and extending to the top surface of said main housing body, and alongside of which said pellet is dropped into the bottom of the main housing body; one of said contact members is a rigid member when mounted in the housing and has an interior end portion adapted to extend along said shoulder to one side of said pellet at said one end of said housing to be rigidly supported thereagainst, and has a horizontally extending lead attachment portion adapted to extend horizontally outwardly from between said top surface of said main housing body and the cover, the other contact member is a flexible member when mounted in the housing and has a horizontally extending lead attachment portion adapted to extend horizontally outwardly from between the top surface at the other end of said main housing end and the cover; the flexible contact member has an interior portion including a first section adapted to entend downwardly from the inner end of said lead attachment portion and terminating in a horizontally extending section having an upturned tip end adapted to engage the interior portion of said second contact member braced by said sloping shoulder; and wherein the pellet and rigid contact member are first inserted into said channel-forming compartment of said main housing body, said flexible contact member is next inserted into said channel-forming compartment in said main housing body so that the horizontal extending section thereof rests upon the top of said pellet at the bottom of said main housing body; said C-shaped spring member is last placed within said channel-forming compartment in said housing so that the lower leg thereof bears upon the upper face of the horizontally extending section of said flexible contact member; and then said cover is secured over the open top of said housing so that the cover presses down against the upper leg of said spring to compress the sandwich of elements therebelow within the main housing body.

* * * * *